United States Patent [19]

Oda

[11] Patent Number: 4,866,829

[45] Date of Patent: Sep. 19, 1989

[54] METHOD OF PRODUCING A CERAMIC ROTOR

[75] Inventor: Isao Oda, Nagoya, Japan

[73] Assignee: NGK Insulators, Ltd., Nagoya, Japan

[21] Appl. No.: 186,787

[22] Filed: Apr. 25, 1988

Related U.S. Application Data

[62] Division of Ser. No. 432,293, Oct. 1, 1982, abandoned.

[30] Foreign Application Priority Data

May 31, 1982 [JP] Japan ..... 57-92628

[51] Int. Cl.[4] ..... B21K 3/04

[52] U.S. Cl. ..... 29/156.8 R; 29/407; 51/165 R; 416/241 B

[58] Field of Search ..... 29/156.8 R, 407, 156.8 CF, 29/445, DIG. 19; 416/241 B, 244 A; 60/39, 45 A; 417/64; 51/165 R, DIG. 33

[56] References Cited

U.S. PATENT DOCUMENTS

| | | | |
|---|---|---|---|
| 2,301,291 | 11/1942 | Kolesnik | 51/165 R |
| 2,474,883 | 7/1949 | Zenor | 51/165 R |
| 2,730,794 | 1/1956 | Schorner . | |
| 3,295,413 | 1/1967 | De Coye De Castelet | 51/165 R |
| 3,848,369 | 11/1974 | Monajjem | 51/165 R |
| 3,881,845 | 5/1975 | Hauck | 416 B/241 B |
| 3,885,294 | 5/1975 | Chaundy et al. | 416/241 B X |
| 3,887,411 | 6/1975 | Goodyear et al. | 416/241 B |
| 3,905,723 | 9/1975 | Torti | 416/244 A X |
| 4,063,850 | 12/1977 | Hueber et al. | 446/241 B X |
| 4,063,939 | 12/1977 | Weaver et al. | 75/208 R |
| 4,096,615 | 6/1978 | Cross | 29/156.8 R |
| 4,097,276 | 6/1978 | Six | 416/244 A X |
| 4,123,199 | 10/1978 | Shimizu et al. | 416/244 A |
| 4,125,344 | 11/1978 | Tiefenbacher | 416/183 |
| 4,164,102 | 8/1979 | Lohrum et al. | 416/241 B X |
| 4,167,051 | 5/1979 | Nakamura et al. | 416/241 B X |
| 4,176,519 | 12/1979 | Kronogard | 60/39.16 R |
| 4,214,906 | 7/1980 | Langer | 75/208 R |
| 4,269,570 | 5/1981 | Rao | 417/64 |
| 4,274,811 | 6/1981 | Rao | 417/64 |
| 4,362,471 | 12/1982 | Langer et al. | 416/244 A |
| 4,369,020 | 1/1983 | Rahnke | 416/241 B |
| 4,408,959 | 10/1983 | Long et al. | 416/241 B |
| 4,501,095 | 2/1985 | Drinkuth et al. | 29/156.8 R |
| 4,586,225 | 5/1986 | Bouiller et al. | 29/156.8 R |

FOREIGN PATENT DOCUMENTS

| | | | |
|---|---|---|---|
| 2507512 | 6/1976 | Fed. Rep. of Germany | 416/241 B |
| 2647301 | 5/1978 | Fed. Rep. of Germany | 416/241 B |
| 2845715 | 4/1980 | Fed. Rep. of Germany | 416/241 B |
| 73205 | 6/1977 | Japan | 416/241 B |

*Primary Examiner*—Howard N. Goldberg
*Assistant Examiner*—Irene Cuda
*Attorney, Agent, or Firm*—Arnold, White & Durkee

[57] ABSTRACT

A ceramic rotor is produced by sequentially forming a ceramic rotary body portion, measuring the dynamic unbalance of the ceramic rotary body portion, grinding the ceramic rotary body portion to adjust the dynamic unbalance and then integrally coupling a rotary shaft to the ceramic rotary body portion.

10 Claims, 1 Drawing Sheet

METHOD OF PRODUCING A CERAMIC ROTOR

This is a division of application Ser. No. 432,293, filed Oct. 1, 1982, now abandoned.

BACKGROUND OF THE INVENTION

1. Field of the Invention

This invention relates to a ceramic rotor which is suitable for a supercharger, a turbocharger, or a gas turbine engine.

2. Description of the Prior Art

From the standpoint of saving energy, improvement in the efficiency of an engine has been recently studied. For example, by supercharging air into engines or by raising the engine operating temperature experimenters have hoped to increase the efficiency of engines. Rotors for such engines are exposed to a high temperature gas and required to revolve at a high speeds, and in the case of superchargers, turbochargers, and gas turbine engines, the rotor rotates at a peripheral speed of 100 m/sec or higher in an atmosphere of 800° C. to 1,500° C. Thus, a very large tensile stress is applied to the rotor, so that the rotor must be made of material having an excellent high-temperature strength. Materials for such as, nickel-cobalt-base heat-resisting metals have been used for rotor construction, because the conventional heat resisting metals have difficulty in withstanding temperatures in excess of 1,000° C. for long periods of time. Additionally, the conventional heat-resisting metals are costly. As a substitute for the heat-resisting metals, the use of ceramic materials with excellent high-temperature characteristics such as silicon nitride ($Si_3N_4$), silicon carbide (SiC) or sialon have been studied.

The ceramic rotors of the prior art made of the above-mentioned ceramic materials have a serious shortcoming in that, when a large tensile stress is applied to the ceramic portion of the rotor during high-speed rotation at a high temperature, the ceramic portions are susceptible to catastrophic failure caused by the high tensile stress applied thereto because the ceramic material is brittle. Thus, a very strong ceramic material with an extremely high modulus of rupture is required to withstand the large tensile stresses.

SUMMARY OF THE INVENTION

Therefore, an object of the present invention is to obviate the above-mentioned shortcoming of the prior art. The inventor has analyzed the castastrophic failure mechanism of the ceramic rotors in detail, and found that the reason for failure is in a comparatively large unbalance of the ceramic portion which is made of brittle ceramic material.

More particularly, the ceramic portion of the conventional ceramic rotor is made of brittle ceramic material and has a comparatively large unbalance, so that during high-speed rotation at a high temperature an excessively large stress acts on a certain localized area of the ceramic portion thereby concentrating stress in the localized area. Accordingly, the present invention reduces the unbalance of the ceramic portion of the ceramic rotor to a value lower than a predetermined level, so as to provide a ceramic rotor which is free from catastrophic failure resulting from stress concentration from an imbalanced ceramic rotor, even if being rotated at a high speed and at a high temperature.

More specifically, a ceramic rotor according to the present invention has at least a rotary body portion thereof made of ceramic in such a manner that the ceramic portion of the ceramic rotor has a dynamic unbalance of less than 0.5 g.cm.

BRIEF DESCRIPTION OF THE DRAWINGS

For a better understanding of the invention, reference is made to the accompanying drawings, wherein.

Throughout different views of the drawings, 1 is a through hole, 2 and 8 are shaft holes, 3 is a blade portion, 4 and 6 are blade-holding portions, 5 is a metallic shaft, and 7 is a blade.

DESCRIPTION OF THE PREFERRED EMBODIMENTS

Figure 1:
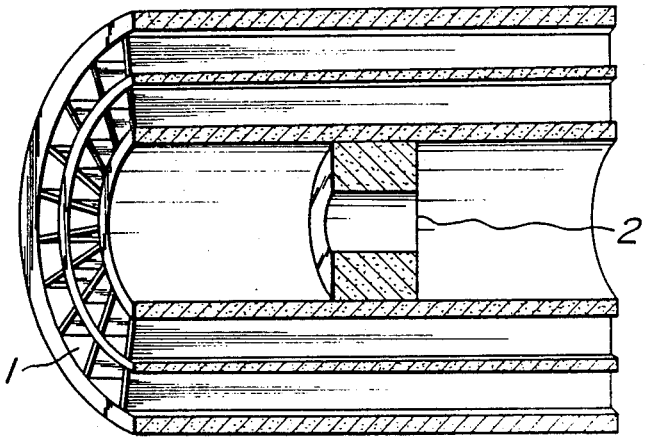
FIG. 1 is a schematic partial perspective view of a ceramic rotor for a pressure wave supercharger, showing a section along the longitudinal axis thereof.
Figure 2:
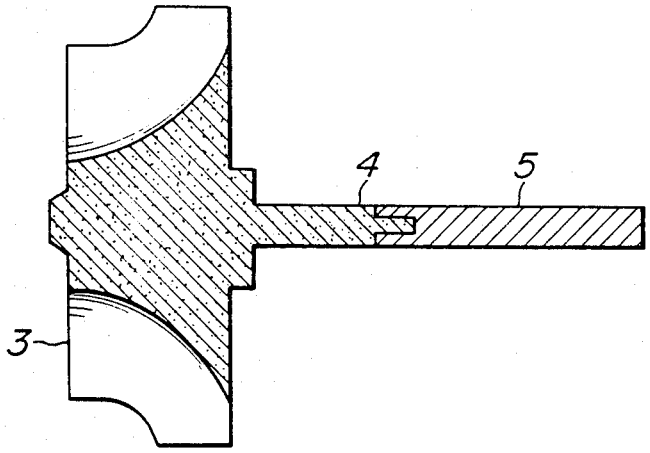
FIG. 2 is a schematic sectional view of a ceramic rotor for a radial turbocharger.
Figure 3:
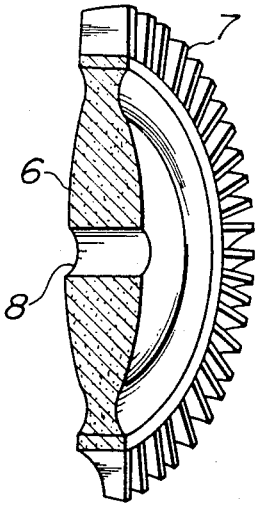
FIG. 3 is a schematic partial perspective view of a ceramic rotor for an axial-flow type gas turbine engine, showing a section along the longitudinal axis thereof.

Pertaining to the construction of a rotor utilizing a ceramic material, three typical examples are shown in the drawings; FIG. 1 shows a ceramic rotor for a pressure wave supercharger which supercharges by means of exhaust gas pressure wave, FIG. 2 shows a ceramic rotor for a radial turbocharger, and FIG. 3 shows a ceramic rotor used for an axial-flow type gas turbine engine. The ceramic rotor of the pressure wave supercharger of FIG. 1 has a plurality of through holes 1 which are formed when the rotor is made by the extrusion a ceramic material. The ceramic rotor has a hub with a shaft hole 2, said hub being fixed at the central opening of the ceramic rotor. The turbocharger rotor of FIG. 2 has a rotary body portion 3 (a blade portion 3) made of ceramic material and a rotary body-holding portion 4 (a blade-holding portion 4) including a shaft which is a composite body of ceramic and metal. The gas turbine engine rotor of FIG. 3 comprises a rotary body-holding portion 6 (a blade-holding portion 6) having a wheel shape with a central shaft hole 8. The rotary body-holding portion is manufactured by hot pressing silicon nitride ($Si_3N_4$), and the blades 7 are made by slip casting or injection molding of silicon (Si) powder followed by firing and nitriding to produce sintered silicon nitride ($Si_3N_4$). The blades 7 are integrally connected to the rotary body-holding portion 6.

The ceramic rotors of the prior art had a serious shortcoming in that they are susceptible to breakage due to the comparatively large unbalance therein as pointed out above. The present invention obviates these shortcomings of the prior art.

The shape of a ceramic rotor according to the present invention can be that of a pressure wave supercharger rotor of FIG. 1, a turbocharger rotor of FIG. 2, a gas turbine engine rotor of FIG. 3, or the like. The ceramic rotor of the invention has a rotary body portion made of ceramic material such as silicon nitride ($Si_3N_4$), silicon carbide (SiC), or sialon, and a rotary body-holding portion made of ceramic, metal, or a combination of ceramic and metal. As a feature of the invention, the ceramic portion of the ceramic rotor of the invention has a dynamic unbalance of less than 0.5 g.cm, more preferably less than 0.1 g.cm, whereby even when the ceramic rotor rotates at a high speed, the small value of the dynamic unbalance eliminates any occurrence of large localized stresses in the ceramic portion. Thus, an advantage of the present invention is in that the ceramic rotor of the invention is very hard to break because of the small dynamic unbalance therein.

The "rotary body-holding portion" of the ceramic rotor of the present invention can be made into different shapes depending on the requirements of different applications; namely, a rotary body-holding portion having a shaft hole which is fittingly engaged with a rotary shaft, as in the case of a pressure wave supercharger rotor of FIG. 1, or a blade-holding portion having a rotary shaft integrally connected thereto, as in the case of a radial turbocharger of FIG. 2, or a blade-holding portion corresponding to a wheel, as in the case of an axial-flow type gas turbine rotor of FIG. 3.

As to the structure of the rotary shaft integral with the blade-holding portion of the radial-flow type turbocharger rotor, three different types are possible; a rotary shaft which is wholly made of ceramic material, a rotary shaft having a ceramic shaft portion and a metallic shaft portion, coupled to the ceramic shaft portion as shown in FIG. 2, or a metallic rotary shaft extending through the central portion of the ceramic rotor.

The inventor measured the unbalance of the ceramic rotor by using a dynamic unbalance tester. Opposite edge surfaces of the ceramic rotor were assumed to be modifiable surfaces, and the dynamic unbalance was measured at such modifiable surfaces.

The modification of the dynamic unbalance of the ceramic rotors was effected only at the ceramic portions thereof, and non-ceramic materials such as metallic pins were never used in modifying the dynamic unbalance.

The allowable limit for the dynamic unbalance of a rotor depends on the properties of the material comprising the rotor, The mechanical strength of the rotor material is especially important, and the peripheral speed of the rotating body or the blade portion of the rotor is also very important. The ceramic rotors for pressure wave superchargers, turbochargers, and gas turbine engines, are usually made of ceramic materials having a four-point bending strength greater than 30 $kg/mm^2$, such as silicon nitride ($Si_3N_4$), silicon carbide (SiC), and sialon, and the peripheral speed of the ceramic rotors is larger than 100 m/sec. Accordingly, the inventor has found that the dynamic unbalance of the ceramic rotor of the invention must be less than 0.5 g.cm. If the dynamic unbalance of the ceramic rotor is larger than 0.5 g.cm, an excessively large stress results in the ceramic portion of the ceramic rotor during high-speed rotation thereof, which tends to cause catastrophic failure of the ceramic portion.

The invention will be explained in further detail now by referring to specific examples which should not be inferred as limiting the scope of the present invention.

Example 1

A kneaded mixture containing silicon nitride ($Si_3N_4$) powder as starting material, 5 weight % of magnesium oxide (MgO) as a sintering aid, and 5 weight % of polyvinyl alcohol (PVA) as a plasticizer was prepared. The kneaded mixture was extruded to form a matrix with a plurality of through holes 1 as shown in FIG. 1. A hub with a shaft hole 2 as shown in FIG. 1 was formed from the above-mentioned kneaded mixture containing silicon nitride ($Si_3N_4$) by using a static hydraulic press. The hub was machined into a suitable shape and coupled to the above-mentioned matrix. The coupled matrix and hub were fired for 30 minutes at 1,720° C. in a nitrogen atmosphere whereby, two sintered silicon nitride ($Si_3N_4$) ceramic rotors for pressure wave superchargers as shown in FIG. 1, were produced. Each of the pressure wave charges had a rotor diameter of 118 mm and an axial length of 112 mm.

Unbalance measurements showed that the dynamic unbalance of each ceramic rotor was 1.5 g.cm for one and 5.6 g.cm for the other. The ceramic rotor having a dynamic unbalance of 5.6 g.cm to 0.3 g.cm, was reduced by grinding unbalanced portions thereof with a diamond wheel. The two rotors for the pressure wave superchargers were mounted on a metallic shaft, and the overall unbalance thereof was adjusted to be 0.1 g.cm. Cold spin tests were carried out at room temperature. The result of the cold spin tests showed that the ceramic rotor with a dynamic unbalance of 0.3 g.cm was free from any catastrophic failure or irregularity for rotating speeds up to 31,000 RPM, while the ceramic rotor having a dynamic unbalance of 1.5 g.cm catastrophically failed at a rotating speed of 14,800 RPM.

Example 2

A kneaded mixture containing silicon nitride ($Si_3N_4$) powder as starting material, 3.0 weight % of magnesium oxide (MgO), 2 weight % of strontium oxide (SrO), and 3 weight % of cerium oxide ($CeO_2$) as sintering aids, and 15 weight % of polypropylene resin was prepared. Two ceramic rotors for radial turbochargers, as shown in FIG. 2 were formed by injection molding of the above-mentioned kneaded mixture, degreasing the molded body at 500° C., and sintering the degreased body for 30 minutes at 1,700° C. in a nitrogen atmosphere. Each of the two ceramic rotors for radial superchargers had a blade portion 3 having a maximum diameter of 70 mm and a blade-holding portion 4 integrally connected to the blade portion 3 at a portion thereof.

Unbalance measurement showed that the dynamic unbalances of the two ceramic rotors were 1.3 g.cm for one and 0.9 g.cm for the other. The ceramic rotor having a dynamic unbalance of 1.3 g.cm to 0.08 g.cm was reduced by grinding a part of the ceramic blade portion 3 with a diamond wheel. Both of the ceramic rotors for turbochargers were coupled to a metallic shaft 5, as shown in FIG. 2. The overall unbalance of each coupled ceramic rotor 5 was further adjusted to 0.005 g.cm. Each of the ceramic rotors were tested by attaching it to a spin tester and gradually raising its rotating speed. As a result, it was found that the ceramic rotor with the dynamic unbalance of 0.08 g.cm did not show any irregularity at revolving speeds of up to 128,000 RPM (corresponding to a peripheral speed of 469 m/sec), while the blade portion 3 of the ceramic rotor with the dynamic unbalance of 0.9 g.cm catastrophically was failed at a rotating speed of 45,600 RPM (corresponding to a peripheral speed of 167 m/sec).

Example 3

Two kinds of slip, one containing starting material of silicon nitride ($Si_3N_4$) and one containing starting material of silicon carbide (SiC), were prepared by adding 5 weight % of magnesium oxide (MgO) and 3 weight % of alumina ($Al_2O_3$) in the case of $Si_3N_4$, and 3 weight % of boron (B), and 2 weight % of carbon (C) in the case of SiC, as sintering aids, and 1 weight % of sodium alginate as a deflocculating agent in each of the two kinds of slip. The blades 7 of the ceramic rotor for the axial-flow type turbine engines, as shown in FIG. 3, had a maximum diameter of 90 mm and were prepared as sintered silicon nitride ($Si_3N_4$) blades and as sintered silicon carbide (SiC) blades, more particularly, blade bodies were formed by slip casting of each of the above-mentioned two types of slip, utilizing gypsum molds. The blade bodies were sintered at 1,750° C. for 30 minutes in a nitrogen atmosphere in the case of silicon nitride ($Si_3N_4$) blades; while at 2,100° C. for one hour in an argon atmosphere in the case of silicon carbide (SiC) blades. Wheel-shaped blade-holding portions 6 were manufactured by a hot pressing while using the same materials as those comprising the blades 7. The blades 7 were mounted one by one onto grooves of each of the blade-holding portions 6, while applying silicon nitride ($Si_3N_4$) slip, to the blades 7 made of silicon nitride and applying the silicon carbide (SiC) slip to the blades 7 made of silicon carbide. The blades 7 were integrally coupled to each of the blade-holding portions 6 by effecting the hot pressing process after mounting the blades 7 to the blade-holding portions 6. Thus, four gas turbine ceramic rotors were prepared, two for each of the two kinds of the starting materials. The dynamic unbalances of the ceramic rotors thus prepared were measured by a dynamic unbalance tester. Of the two ceramic rotors of each starting material, the dynamic unbalance of one ceramic rotor was modified to have an unbalance of 0.05 g.cm by grinding with a diamond wheel, while the dynamic unbalance of the other of the two ceramic rotors was left as prepared. Ultimate dynamic unbalances were 0.05 g.cm and 1.9 g.cm for the silicon nitride ($Si_3N_4$) rotors and 0.05 g.cm and 0.7 g.cm for the silicon carbide (SiC) rotors. Each of the four ceramic rotors thus processed was tested by attaching it to a spin tester and gradually raising its roating speed. As a result, it was found that the ceramic rotors of the two kinds with the modified dynamic unbalance of 0.05 g.cm did not show any irregularity at rotating speeds of up to 100,000 RPM, while the blade portions of both the silicon nitride ($Si_3N_4$) rotor with the dynamic unbalance of 1.9 g.cm and the silicon carbide (SiC) rotor with the dynamic unbalance of 0.7 g.cm, catastrophically failed at a rotating speed of 30,000 RPM.

As described in the foregoing, a ceramic rotor according to the present invention comprises a rotary body portion and a rotary body-holding portion holding said rotary body portion, and the ceramic rotor has at least the rotary body portion made of ceramic material in such a manner that the portion made of the ceramic material has a dynamic unbalance of less than 0.5 g.cm. Whereby, the portion made of the ceramic material is free from any uneven stresses even during high-speed rotation at a high temperature, so that the ceramic rotor of the invention has an excellent durability without the risk of castrophic failure due to unbalance of the ceramic portion, even when subjected to high-speed rotation at a high temperatures. The ceramic rotor of the invention can be used in various industrial fields with outstanding advantages, for instance as a pressure wave supercharger rotor, a turbocharger rotor, or a gas turbine engine rotor.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A method of producing a bladed ceramic rotor, sequentially comprising:
   - forming a ceramic rotary body portion;
   - measuring the dynamic unbalance of said ceramic rotary body portion;
   - grinding said ceramic rotary body portion to adjust the dynamic unbalance of said body portion to a value not greater than 0.5 g-cm;
   - integrally coupling a rotary shaft to said ceramic rotary body portion to form said bladed ceramic rotor; and
   - grinding said rotary shaft to adjust the dynamic unbalance of said bladed ceramic rotor to a value not greater than 0.1 g-cm.

2. A method according to claim 1, wherein said dynamic unbalance of said body portion is adjusted to a value not greater than 0.1 g-cm.

3. A method according to claim 1, wherein said grinding is performed using a diamond wheel.

4. A method according to claim 1, wherein said bladed ceramic rotor is used for a pressure wave supercharger, a radial turbocharger, or an axial-flow type gas turbine engine.

5. A method according to claim 1, wherein said bladed ceramic rotor is made of at least one material selected from the group consisting of silicon nitride, silicon carbide, and sialon.

6. A method of producing a composite bladed ceramic rotor sequentially comprising:
   - forming a ceramic rotary body portion;
   - measuring the dynamic unbalance of said ceramic rotary body portion;
   - grinding said ceramic rotary body portion to adjust the dynamic unbalance of said body portion to a value not greater than 0.5 g-cm; and
   - integrally coupling a rotary shaft to said ceramic rotary body portion to form said bladed ceramic rotor.

7. A method according to claim 6, wherein said dynamic unbalance of said body portion is adjusted to a value not greater than 0.1 g-cm.

8. A method according to claim 6, wherein said grinding is performed using a diamond wheel.

9. A method according to claim 6, wherein said bladed ceramic rotor is used for a pressure wave supercharger, a radial turbocharger, and an axial-flow type gas turbine engine.

10. A method according to claim 6, wherein said bladed ceramic rotor is made of at least one material selected from the group consisting of silicon nitride, silicon carbide, and sialon.

* * * * *